United States Patent [19]

Slemmons

[11] 4,143,848

[45] Mar. 13, 1979

[54] ART OBJECT ADJUSTABLE MOUNTING ASSEMBLY

[76] Inventor: John W. Slemmons, 19142 Glenn Albyn, Orange, Calif. 92669

[21] Appl. No.: 757,821

[22] Filed: Jan. 10, 1977

[51] Int. Cl.[2] ..... A47G 1/16

[52] U.S. Cl. ..... 248/489

[58] Field of Search ..... 248/11, 188.2, 242, 248/274, 469, 476, 489, 495; 403/375, 359

[56] References Cited

U.S. PATENT DOCUMENTS

| | | | |
|---|---|---|---|
| 816,588 | 4/1906 | Moore | 248/467 |
| 3,300,173 | 1/1967 | Kennedy | 248/467 |
| 3,350,045 | 10/1967 | Mayers | 248/467 X |
| 3,946,979 | 3/1976 | Ehlebracht et al. | 248/476 X |

FOREIGN PATENT DOCUMENTS

| | | | |
|---|---|---|---|
| 934250 | 9/1955 | Fed. Rep. of Germany | 248/495 |
| 1429553 | 11/1968 | Fed. Rep. of Germany | 248/495 |
| 224092 | 11/1924 | United Kingdom | 248/242 |
| 518642 | 3/1940 | United Kingdom | 248/188.2 |

*Primary Examiner*—William H. Schultz
*Attorney, Agent, or Firm*—Philip M. Hinderstein

[57] ABSTRACT

A mounting assembly for supporting posters, pictures, and other art objects on a vertical surface, comprising first and second mounting means adapted for supporting the art object at two horizontally spaced points, each mounting means including a post, means for securing one end of the post to the vertical surface with the longitudinal axis thereof perpendicular to the surface, and a disc having an off-center hole therein, the diameter and cross-sectional shape of the hole being approximately the same as those of the post, the post extending through the hole in the disc, the discs of the two mounting means being adapted to support the art object on the uppermost edges thereof, the discs of the two mounting means being individually rotatable relative to their associated posts to level an art object supported thereon.

10 Claims, 10 Drawing Figures

FIG. 1.
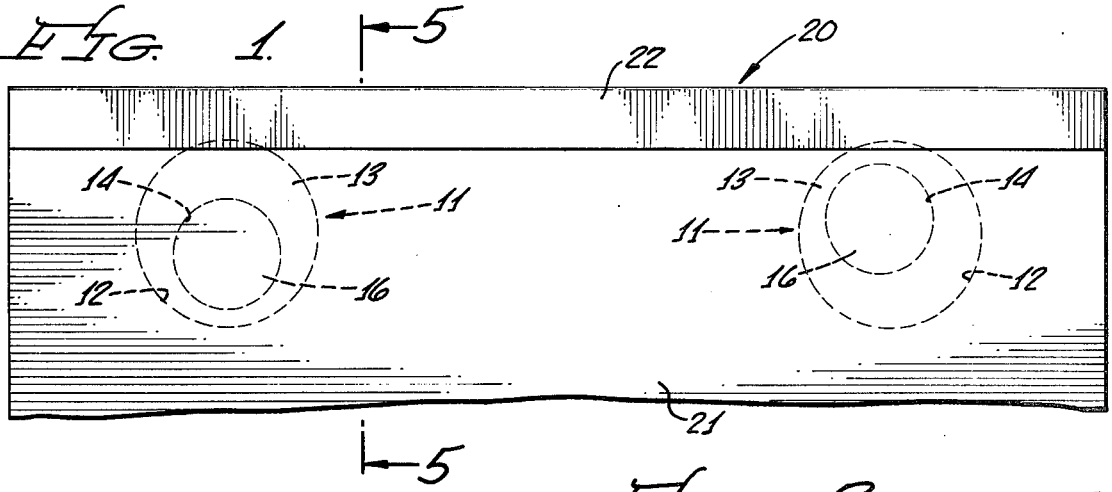
FIG. 2.
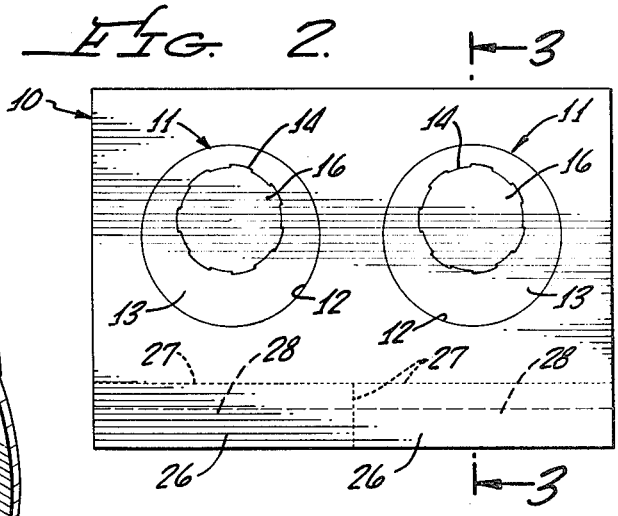
FIG. 4.
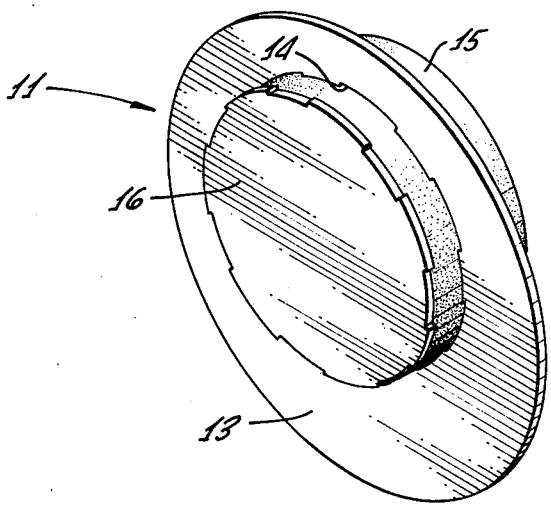
FIG. 5.
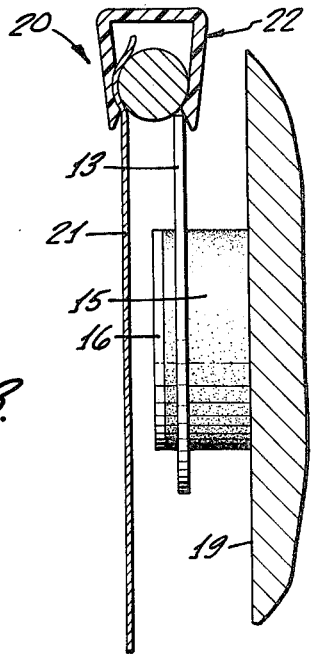
FIG. 6.
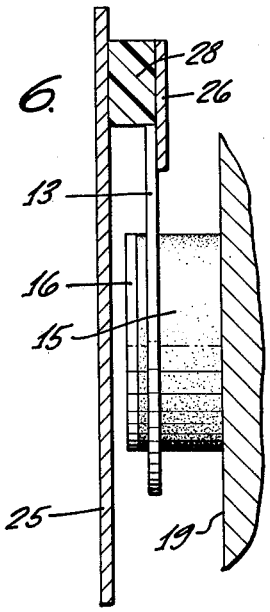
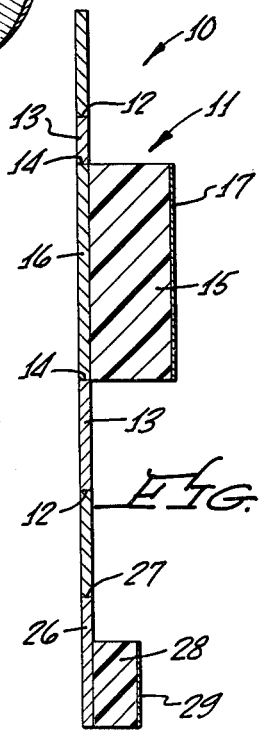
FIG. 3.

ART OBJECT ADJUSTABLE MOUNTING ASSEMBLY

BACKGROUND OF THE INVENTION

1. Field of the Invention

The present invention relates to an art object adjustable mounting assembly and, more particularly, to a mounting assembly for stabilizing and leveling large art objects such as posters, pictures, and the like.

2. Description of the Prior Art

A wide variety of art objects are supported for display on a wall or other vertical surface. Conventional mounting assemblies include nails and other similarly functioning members from which the art objects are suspended.

Many art objects are quite large, such as posters, prints, scrolls, charts, tapestries, and the like, presenting special problems in the mounting thereof. That is, large art objects are highly susceptible to motion in the presence of room vibrations, air currents, and the like, making it difficult, if not impossible, to maintain such art objects level. Commonly, when entering a room having one or more art objects mounted on the walls thereof, one or more of such art objects are askew, detracting from the appearance thereof.

A poster is especially susceptible to this problem. In my prior U.S. Pat. No. 3,591,940, issued July 13, 1971, there is disclosed a supporting frame for posters, charts, bulletins, and the like wherein two opposite edges of the poster are releasably clamped to frame members and a spring member is wedged between the frame members to force the frame members apart. As a result, the edges of the poster are supported and the poster is suspended under tension between the frame members. However, even with the frame so supported, the poster is mounted from a single point, making the poster highly unstable in use.

The only practical solution to this problem is to utilize two separate mounting means for supporting an art object at two horizontally spaced points which are far enough apart to provide stability, yet close enough together to fit within the dimensions of the art object. Unfortunately, it is very difficult to drive nails or other conventional mounting assemblies into a wall so that when the art object is hung, the horizontal sides will be exactly level.

Various means have been proposed for overcoming this latter problem. One such means is the picture hanger assembly disclosed in U.S. Pat. No. 3,330,525, issued July 11, 1967, to Louis Weinstein. Weinstein discloses a picture hanger assembly comprised of a flat, disc-shaped member having a centrally located aperture and a continuous spiral-shaped slot winding about the central aperture. A nail is inserted through the central aperture and one end of a member hooked at both ends is hung in the spiral-shaped slot. The other hooked end is available to receive the wire or loop normally provided at the back of a picture. By rotating the flat member about the nail inserted through the central opening, an arcuate portion of varying distance from the central opening may be positioned immediately below the central opening so as to raise or lower a picture suspended from the assembly. By using two of such picture hanger assemblies, a picture may be leveled.

A number of problems still exist with devices of the type disclosed by Weinstein. That is, the device of Weinstein still requires a wire or loop connected to the back of a picture, and such is not always practical or feasible, such as in the case of a poster. Secondly, when mounting an art object with the device of Weinstein, the art object is always suspended below the picture hanger assembly, which would make the assembly visible when mounting a picture from the top edge thereof. Obviously, having the assembly visible would detract from the appearance of the displayed art object.

SUMMARY OF THE INVENTION

According to the present invention, there is provided a mounting assembly for supporting posters, pictures, and other art objects which solves these problems in a manner unknown heretofore. With the present mounting assembly, an art object can be mounted in a stable and level manner, unsusceptible to motion from air currents, vibrations, and the like. The present mounting assembly is ideally suited for posters and other objects which are supported by the upper edges thereof, since such objects are supported with the present mounting assembly completely hidden from view. While ideally suited for posters and the like, however, the present mounting assembly obviously has wide applicability for supporting a great variety of different types of art objects.

Briefly, the present mounting assembly for supporting posters, pictures, and other art objects on a vertical surface comprises first and second mounting means adapted for supporting the art object at two horizontally spaced points, each mounting means including a post, means for securing one end of the post to the vertical surface with the longitudinal axis thereof perpendicular to the surface, and a disc having an off-center hole therein, the diameter and cross-sectional shape of the hole being approximately the same as those of the post, the post extending through a hole in the disc, the discs of the two mounting means being adapted to support the art object on the uppermost edges thereof, the discs of the two mounting means being individually rotatable relative to their associated posts to level an art object supported thereon.

According to one embodiment of the invention, the discs of the first and second mounting means are formed from a single piece of cardboard having first and second sets of perforations therein defining the discs, each disc further having perforations therein defining the locations of the holes therein, the other ends of the posts being secured to one side of the discs, within the areas defined by the further perforations, whereby puncturing of the perforations in the single piece of cardboard frees the discs and forms the off-center holes therein, simultaneously forming a serrated, irregular edge in each disc for engaging the posts to create a frictional engagement so as to inhibit undesired rotation of the discs relative to the posts.

OBJECTS

It is therefore an object of the present invention to provide an art object adjustable mounting assembly.

It is a further object of the present invention to provide a mounting assembly for stabilizing and leveling large art objects such as posters, pictures, and the like.

It is a still further object of the present invention to provide a mounting assembly which is ideally suited for posters and other art objects which are supported by the upper edges thereof.

It is a still further object of the present invention to provide an art object mounting assembly which is completely hidden from view.

Still other objects, features, and attendant advantages of the present invention will become apparent to those skilled in the art from a reading of the following detailed description of the preferred embodiments constructed in accordance therewith, taken in conjunction with the accompanying drawings wherein like numerals designate like or corresponding parts in the several figures and wherein:

BRIEF DESCRIPTION OF THE DRAWINGS

FIG. 1 is a pictorial view of a poster mounted on a wall by means of the present mounting assembly;

FIG. 2 is a front view of the present mounting assembly still attached to the cardboard panel from which it is preferably fabricated;

FIG. 3 is a sectional view taken along the line 3—3 in FIG. 2;

FIG. 4 is a perspective view of a single mounting means of the present mounting assembly;

FIG. 5 is a sectional view taken along the line 5—5 in FIG. 1;

FIG. 6 is a view similar to FIG. 5 showing an alternative means for supporting an art object with the present mounting assembly.

DESCRIPTION OF THE PREFERRED EMBODIMENT

Figure 7:
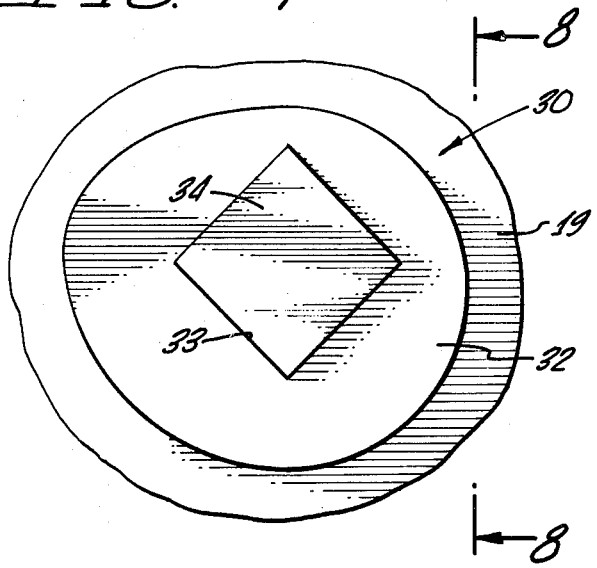
FIGS. 7 and 9 are front views and FIGS. 8 and 10, respectively, are side views of alternate embodiments of mounting means according to the present invention.

Referring now to the drawings and, more particularly, to FIGS. 2, 3, and 4 thereof, there is shown a unitary panel 10, which may be made from cardboard or other suitable material, from which is die cut two identical mounting means, generally designated 11, which form the present mounting assembly. Panel 10 has formed therein two sets of perforations 12, in circular patterns, which are incompletely severed from panel 10, remaining attached thereto by connecting segments spaced along perforations 12. When perforations 12 are punctured, permitting removal of mounting means 11 from panel 10, it is seen that each mounting means 11 includes a thin disc 13.

Within the areas defined by discs 13, panel 10 has formed therein two additional sets of perforations 14, in circular patterns, the centers of which are off-set from the centers of perforations 12. Perforations 14 are also incompletely severed from panel 10, remaining attached thereto by connecting segments spaced along perforations 14. When perforations 14 are punctured, as shown in FIG. 4, disc 13 is provided with an off-center hole, defined by perforations 14, leaving a thin circular member 16.

Affixed to the rear surface of each member 16 of each mounting means 11 is a cylindrical post 15 which is perferably formed from a resilient material such as plastic or rubber foam. Post 15 has a diameter equal to the diameter of perforations 14 and one end of post 15 is secured to member 16. For this purpose, post 15 has an adhesive on the opposite ends thereof, the adhesive on one end being provided for connection to circular member 16. The adhesive on the other end of post 15 is for securing such end to a vertical surface with the longitudinal axis of each post 15 perpendicular to such surface. A protective label 17 protects the adhesive prior to use.

Referring now to FIGS. 1–4, when using mounting means 11, perforations 12 and 14 are punctured to separate discs 13 from panel 10 and to separate posts 15 and circular members 16 from discs 13. Marks are drawn on a wall 19 or other surface at two points far enough apart to provide stability to the art object to be hung, yet close enough together to fit within the dimensions of the art object. Protective labels 17 are then removed from posts 15 and posts 15 are secured to wall 19 at the previously marked two places.

With posts 15 secured to wall 19, discs 13 are freely rotatable relative to posts 15. Discs 13 are then rotated to a common position, either with the large portions pointing upwardly, as shown to the left in FIG. 1, or pointing downwardly, not shown. An art object, generally designated 20, is then positioned on mounting means 11, as will be described more fully hereinafter, supported on the uppermost edges of discs 13. If the art object is not level, the disc 13 of one or the other of mounting means 11 may be rotated to raise or lower the side requiring raising or lowering until the desired position of the art object is achieved.

As explained previously, post 15 is made from a resilient material, such as plastic or rubber foam. Furthermore, when perforations 14 are punctured to separate discs 13 from circular members 16 and posts 15, each set of perforations 14 forms a serrated, irregular edge which engages the outer surfaces of posts 15. The serrated edges formed by perforations 14 create a frictional engagement between discs 13 and posts 15 so as to inhibit undesired rotation of discs 13 relative to posts 15. Thus, when discs 13 are rotated to the desired positions, as shown in FIG. 1, discs 13 remain in such positions, supporting art object 20 in a level condition.

It should be obvious that mounting means 11 may be utilized to support a wide variety of art objects in a number of different ways. For example, and referring to FIG. 5, art object 20 may be a poster 21 having secured to the top edge thereof a frame member 22 as described in my before-mentioned U.S. Pat. No. 3,591,940. Frame member 22 provides a convenient lip along the back of the top edge of poster 21 for resting on the uppermost edges of discs 13. As shown in FIG. 1, discs 13 may be positioned entirely within the borders of poster 21, being completely hidden from view.

Referring now to FIGS. 2, 3, and 6, panel 10 may also incorporate means for mounting to wall 19 an art object 25 having no lip for engaging discs 13 of mounting means 11. That is, panel 10 may have die cut therefrom two rectangular panels 26 which are incompletely severed from panel 10, remaining attached thereto by connecting segments spaced along perforated edges 27. Affixed to the rear surface of each panel 26 may be a rectangular pad 28, similar to posts 15, pads 28 being somewhat smaller than panels 26. Pads 28 would have an adhesive on the opposite ends thereof, the adhesive on one end being provided to permit connection to panels 26. The adhesive on the other end would be protected by a suitable label 29.

In use of panels 26, perforations 27 are punctured to separate the two panels 26. Protective labels 29 are then removed from pads 28 and pads 28 are secured to the back of art object 25, with those portions of panels 26 unconnected to pad 28 pointing downwardly, as shown in FIG. 6. In this manner, the two pads 28 provide two surfaces for resting on the uppermost edges of discs 13 of mounting means 11 and panels 26 insure that pads 28 will not slip off of discs 13.

Still further, many art objects are provided with their own lips on the back surfaces thereof for hanging on discs 13. Accordingly, the embodiments of FIGS. 5 and 6 are not to be construed in a limiting sense, but only as examples of the many ways in which mounting means 11 may be secured to an art object.

Mounting means 11 and panels 26 are preferably die cut from a single cardboard panel 10, since such embodiment is simple and low in cost and ideally suited for lightweight art objects, such as posters, the cardboard of panel 10 providing sufficient strength to support the posters. By incompletely severing mounting means 11 and panels 26 from panel 10, there remains a unitary article which may be handled easily during distribution and sale. In this regard, the portions of panel 10 not used for mounting means 11 or panels 26 may be imprinted with advertising or instructions. Furthermore, discs 13 may be provided with calibration marks, not shown, to indicate what degree of rotation of discs 13 relative to cylindrical posts 15 provides what amount of raising or lowering of the uppermost edges thereof.

For heavier objects, each of the parts of mounting means 11 could be injection molded out of plastic or other suitable material or manufactured in any other manner known to those skilled in the art. In such a case, the diameter of the off-center hole in discs 13 could be made somewhat smaller than the outside diameter of posts 15 to increase the frictional engagement therebetween to inhibit undesired rotation of discs 13 relative to posts 15 when supporting heavier objects.

Figure 8:
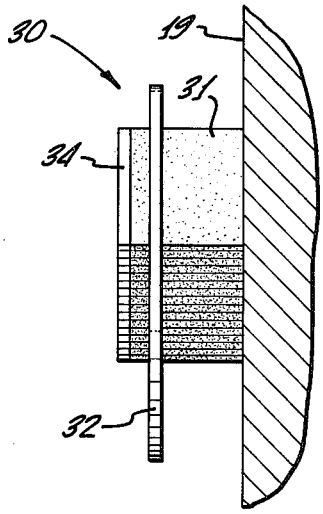
Figure 9:
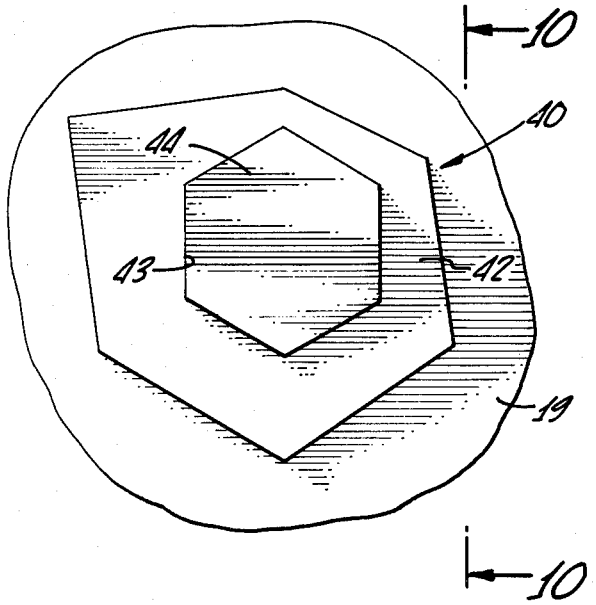
Figure 10:
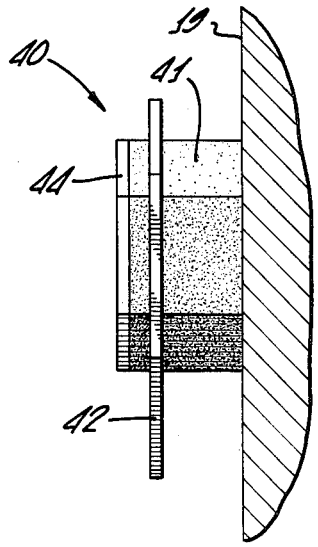

Referring now to FIGS. 7–10, there is shown alternative constructions of mounting means, generally designated 30 and 40, respectively, which may be made in any of the manners described previously, such as being die cut from cardboard or another suitable material. The significance of mounting means 30 and 40 is in the fact that post 15 of mounting means 11 need not be cylindrical, the hole in disc 13 of mounting means 11 need not be circular, and disc 13 itself need not have a circular perimeter. That is, mounting means 30 includes a post 31 which is square in cross-section and mounting means 40 includes a post 41 which is hexagonal in cross-section. Mounting means 30 includes a disc 32 having a curved perimeter and having an off-center hole 33 therein, the diameter and cross-sectional shape of which is approximately the same as the diameter and cross-sectional shape of post 31. Mounting means 40, on the other hand, includes a disc 42 having a hexagonal perimeter and having an off-center hole 43 therein, the diameter and cross-sectional shape of which is approximately the same as the diameter and cross-sectional shape of post 41. If discs 32 and 42 of mounting means 30 and 40, respectively, are die cut from a sheet of cardboard, square and hexagonal members 34 and 44, respectively, will be connected to first ends of posts 31 and 41, respectively. The other ends of posts 31 and 41 are adapted to be connected to wall 19 in the same manner as described previously. Other cross-sectional shapes are obviously possible for posts 31 and 41.

The use of mounting means 30 and 40 is virtually identical to the use of mounting means 11. On the one hand, mounting means 30 and 40 do not have the continuous adjustment capability of mounting means 11. However, for all practical purposes, mounting means 30 and 40 will give the desired degree of adjustment. On the other hand, mounting means 30 and 40 have the advantage of providing a positive locking action between posts 31 and 41 on the one hand and discs 32 and 42, respectively, on the other hand. That is, the height of an art object positioned on either a pair of mounting means 30 or a pair of mounting means 40 can be adjusted by pulling either disc 32 or 42 off of post 31 or 41, respectively, rotating disc 32 or 42 in the desired direction to obtain the proper adjustment, and replacing disc 32 or 42 on post 31 or 41, respectively. In either case, the interference of post 31 or 41 in holes 33 or 43, respectively, will prevent rotation of discs 32 or 42, respectively.

It can therefore be seen that according to the present invention, there is provided a mounting assembly for supporting posters, picture, and other art object which solves the problems encountered heretofore in a simple and effective manner. With mounting means 11, an art object can be mounted in a stable and level manner, unsusceptible to motion from air currents, vibrations, and the like. The present mounting assembly, consisting of first and second mounting means 11, is ideally suited for posters and other objects which are supported by the upper edges thereof, since such objects are supported with mounting means 11 completely hidden from view.

While the invention has been described with respect to the preferred physical embodiments constructed in accordance therewith, it will be apparent to those skilled in the art that various modifications and improvements may be made without departing from the scope and spirit of the invention. Accordingly, it is to be understood that the invention is not to be limited by the specific illustrative embodiments, but only by the scope of the appended claims.

I claim:

1. Mounting means for supporting posters, pictures, and other art objects on a vertical surface, comprising:

a post;

means for securing one end of said post to said vertical surface; and a thin disc having an off-center hole therein, the diameter and cross-sectional shape of said hole in said disc being approximately the same as the diameter and cross-sectional shape of said post, said post extending through said hole in said disc, the edge of said disc defining said hole engaging the side of said post in a manner which inhibits undesired rotation of said disc relative to said post, said disc being adapted to support an art object on the uppermost edge thereof, whereby rotation of said disc relative to said post raises or lowers said art object.

2. Mounting means according to claim 1, wherein said post has an adhesive on said one end thereof for securing said one end of said member to said vertical surface.

3. Mounting means according to claim 1, wherein the perimeter of said disc is circular.

4. Mounting means according to claim 1, wherein the perimeter of said disc consists of a plurality of linear segments.

5. Mounting means according to claim 1, wherein the side of said post consists of a plurality of planar surfaces and wherein said hole in said disc has the same cross-sectional shape as the cross-section of said post.

6. Mounting means according to claim 1, wherein said post is cylindrical and said hole in said disc is generally circular.

7. Mounting means according to claim 6, wherein said post is formed of a resilient material and wherein said edge of said disc engages said post to create a frictional engagement so as to inhibit undesired rotation of said disc relative to said post.

8. Mounting means according to claim 7, wherein said disc is formed from cardboard or other similar material, without said hole, and has perforations therein, in a circular pattern, defining the location of said hole, and wherein the other end of said post is secured to one side of said disc, within the area defined by said perforations.

9. Mounting means according to claim 8, wherein said post is formed from a foam material having an adhesive on opposite ends thereof for connection to said cardboard or other similar material and said vertical surface.

10. A mounting assembly for supporting poster, pictures, and other art objects on a vertical surface comprising:

first and second mounting means adapted to support said art object at two horizontally spaced points, each of said mounting means comprising:

an elongate post;

means for securing one end of said post to said vertical surface; and a thin disc having an off-center hole therein, the diameter and cross-sectional shape of said hole in said disc being approximately the same as the diameter and cross-sectional shape of said post, said post extending through said hole in said disc, the edge of said disc defining said hole engaging the side of said post so as to inhibit undesired rotation of said disc relative to said post;

said discs being adapted to support an art object on the uppermost edges thereof, the discs of said first and second mounting means being individually rotatable to level an art object supported thereby.

* * * * *